US006032721A

United States Patent [19]

Steen

[11] Patent Number: 6,032,721

[45] Date of Patent: Mar. 7, 2000

[54] CASTING EQUIPMENT WITH IMPROVED LUBRICATING FLUID SUPPLY

[75] Inventor: Idar Kjetil Steen, Sunndalsøra, Norway

[73] Assignee: Norsk Hydro ASA, Oslo, Norway

[21] Appl. No.: 09/059,444

[22] Filed: Apr. 14, 1998

[30] Foreign Application Priority Data

Apr. 14, 1997 [NO] Norway ..... 971713

[51] Int. Cl.[7] ..... B22D 11/00; B22D 11/07

[52] U.S. Cl. ..... 164/268; 164/487

[58] Field of Search ..... 164/487, 444, 164/472, 268

[56] References Cited

U.S. PATENT DOCUMENTS 5,678,623 10/1997 Steen et al. ..... 164/487

*Primary Examiner*—Kuang Y. Lin

*Attorney, Agent, or Firm*—Wenderoth, Lind & Ponack, L.L.P.

[57] ABSTRACT

Casting equipment for continuous or semi-continuous direct chill casting of metals, in particular casting of slugs or billets of aluminum, includes a mold having a cavity with an inlet which opens upwards, an intermediate overhang which extends along the mold and is thermally insulated (a hot-top) and an outlet with a support which can be moved vertically, as well as a supply means for supplying water for chilling molten metal. The wall of the cavity is formed wholly or partially of a permeable material and oil and/or gas are/is supplied through the permeable material so as to form an oil and/or gas layer between the metal and the wall of the mold. This prevents the metal from coming into direct contact with the mold wall. At least the part of the cavity wall where the oil is supplied to the cavity is made of the same fireproof material as the hot-top and constitutes an integral part of the hot-top.

10 Claims, 3 Drawing Sheets

FIG. I

CASTING EQUIPMENT WITH IMPROVED LUBRICATING FLUID SUPPLY

The present invention concerns casting equipment for continuous or semi-continuous direct chill (DC) casting of metals, in particular casting slugs or billets of aluminium, comprising a cavity which has an open hot-top inlet, which extends inwardly over the cavity, for the supply of molten metal and an open outlet at which are arranged means for supplying water for direct chilling of the molten metal. The wall of the cavity is comprised wholly or partially of a permeable material and oil and/or gas are/is supplied through the permeable material so as to form an oil and/or gas layer between the metal and the mould wall, which prevents the metal from coming into direct contact with the mould wall.

Supplying oil and/or gas to the cavity in a casting mould as stated above is already known from a number of publications. Among others, U.S. Pat. No. 4,157,728 (Showa) shows DC casting equipment in which oil and gas are supplied simultaneously through narrow slits in the mould wall, which consists of graphite material. On account of the difference in pressure and the capillary effect, the fluids (oil and gas) will partially also be supplied through the graphite material in the area to the side of the slits. However, in practice, it has been shown that the slits which supply the oil and gas can easily become blocked by metal, particularly in the start phase. Moreover, it is difficult to regulate the gas pressure with such slits as it can easily exceed the metal static pressure in the mould (cavity) and thus create unfavourable conditions such as bubbling and oxide formation during the casting process, which, in turn, produce an uneven, inconsistent surface on the cast product.

The casting equipment shown in U.S. Pat. No. 4,157,728 therefore does not produce satisfactory casting results in terms of reproducibility and the quality of the cast product.

The same applies to the casting equipment shown in U.S. Pat. No. 4,598,763 (Wagstaff). Instead of using slits, the oil and gas are supplied to the cavity via one graphite ring or graphite section. The graphite ring is arranged in the cavity in the area where the solidification front of the metal is located during the casting operation. The objective of supplying oil and gas in this area through one ring is to ensure sufficient lubrication while the gas presses the metal away from the graphite ring. However, a major disadvantage of this solution is that the oil which is supplied in the upper part of the ring blocks the pores in the graphite so that the area where the gas is supplied is moved downwards and made continuously narrower, while the oil supply is reduced. The blockage is caused partly because the oil contains small particles which are caught in the pores (the graphite acts as a filter) and partly because the oil cokes in the graphite on account of the high temperature of the oil part of the graphite ring at the solidification front of the metal. In order to counter the pore blocking effect, it is, therefore, normal to leave the gas supply open between casting operations. However, this results in an increased use of gas.

The use of graphite in casting moulds is also known from GB patent application No. 2014487. Here the gas is supplied through a porous ring which is comprised of the wall-forming body in the cavity, while the oil is immersed in the cavity between the liquid metal and the gas membrane. As in the application of the solution shown in U.S. Pat. No. 4,157,728 (Showa), this produces a poor distribution of the lubrication film and high oil consumption.

Moreover, the applicant's own European Patent Application No. 96105516.7 shows a solution in which the oil and gas are supplied separately through two independent rings which are physically separated by means of a sealing element or similar. The upper wall element for the supply of oil is arranged above the area where the solidification front of the metal is located, while the lower wall element for the supply of gas is arranged directly opposite the solidification front of the metal and extends from the lower end of the cavity and over the point of contact of the metal with the mould wall. This solution is almost optimal in terms of technical properties. Among other things, the supplies of oil and gas will not be affected by each other over time, which results in stable conditions in the mould, producing cast workpieces with consistent quality over time in terms of both metallurgical properties and surface quality. Moreover, as the oil is supplied in an area which, during the casting operation, is not in contact with liquid metal, the problem of the oil coking in the oil-carrying ring element is eliminated.

The present invention represents a solution which produces the same optimal technical properties but which is cheaper than the applicant's above prior solution.

The present invention is characterised in that at least the part of the cavity wall where the oil is supplied to the cavity is made of the same fireproof material as the hot-top and constitutes an integrated part of the hot-top.

The dependent claims 2 and 3 indicate advantageous features of the present invention.

In the following, the present invention will be described in further detail using examples and with reference to the attached drawings, where:

FIG. 1 shows, as stated, a diagram of a vertical section through a casting mould 1 for continuous or semi-continuous direct chill casting of metals. The casting mould 1 may be designed to produce billets with a square or rectangular cross-section or it may be designed to produce slugs with a circular or oval cross-section.

Figure 1:
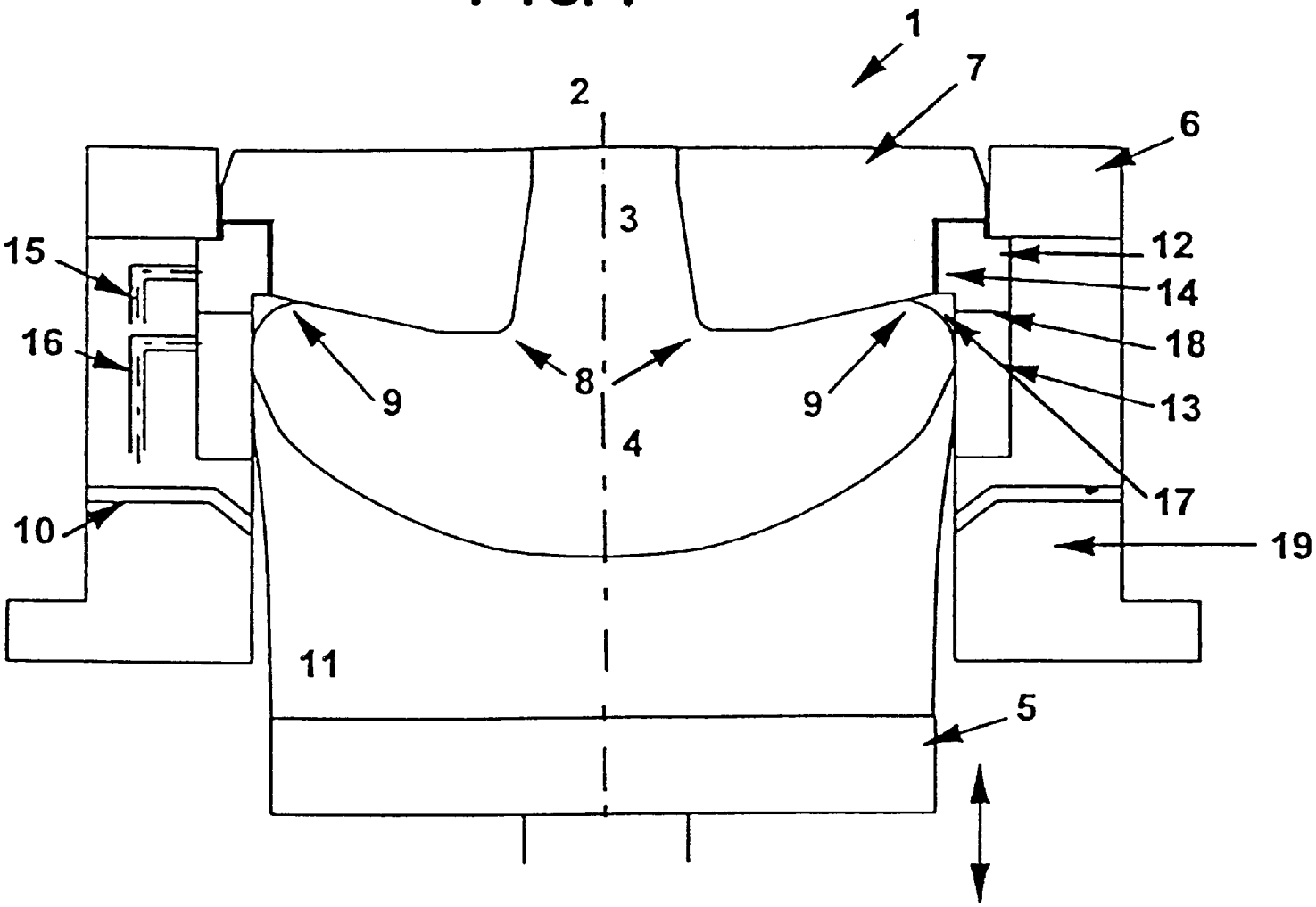
FIG. 1 shows a diagram of a vertical section through a casting mould for continuous or semi-continuous direct chill casting of metals in accordance with the present invention.

On account of the large dimensions, when producing slabs for milling, there will normally only be a few such casting moulds as shown in FIG. 1 per casting equipment unit. For the production of billets, which have considerably smaller dimensions, it is, however, normal, for each casting equipment unit, to place several casting moulds together in a joint frame structure with a joint superjacent reservoir for the supply of molten metal (not shown). When the expression casting mould is used in the following, it may thus be any water-cooled, continuous or semi-continuous casting equipment with any dimensions.

The casting mould shown in FIG. 1 comprises an upper inlet part 2 which opens upwards, a centre part 3 which extends along the mould, and a lower cavity or mould 4 which is open downwards. At the downward-facing open side of the cavity 4, i.e. at the outlet of the cavity, is arranged a support or base part 5 which can be moved vertically by means of a piston/cylinder device or similar (not shown). This support seals tightly against the outlet of the casting mould at the beginning of the casting cycle.

The casting mould consists of an outer sleeve 6, preferably in aluminium or steel, into which the oil element 12 and gas element 13 are fastened by means of a clamping ring (not shown in the FIG.). A fireproof, insulating material 7 is fastened in the inlet part of the casting mould. The casting mould is, in turn, fastened to a mother mould frame, which is not shown on the drawing.

The fireproof material 7 in the casting mould forms the wall in the centre part 3, which is popularly called the hot-top. The hot-top 7 forms a constriction in the cavity of the casting mould in the direction of flow and produces an overhang 9 at the inlet to the actual cavity 4.

At the lower part of the cavity is arranged a water slit 10 for the supply of water which extends along the whole circumference of the cavity and is connected to a water reservoir adjacent to the casting mould (not shown).

When casting metal with this type of equipment, liquid metal is supplied from above through the inlet 2 while the support 5 is moved downwards and the metal surface is chilled directly with water supplied through the water slit 10. This direct chilling of the metal with water has given the process its name: Direct Chill (DC) Casting.

In terms of maintenance and thus costs, it is an advantage for the casting mould design to consist of as few components as possible. The component which must be replaced most often in a casting mould of the above type is the superjacent insulation ring, i.e. the hot-top. The replacement rate will vary from casthouse to casthouse depending on the alloys cast, which material is used and general operating conditions such as daily maintenance and the experience of the casting operator and maintenance personnel.

In order to reduce the number of components, the casting mould costs and thus the total investment and maintenance costs for this type of casting mould, the present invention represents a solution in which at least the part of the cavity wall 12 where the oil is supplied to the cavity is made of the same fireproof material as the hot-top and the oil supply part constitutes an integrated part of the hot-top.

In FIG. 1, the oil distribution ring 12 is glued to the insulation ring 7. These two parts are glued together before the final machining of the components takes place. Thus a perfect transition between the two components is achieved, i.e. the risk of "projections" to which metal can become attached is eliminated. The glue joint 14 will function as a barrier layer between the oil-carrying part of the hot-top and the part which forms the insulating and downflow-restricting part of the cavity. The link between the gas-carrying part 13 and the hot-top 7, 12 is now a horizontal surface 18. The location of this surface 18 must be above the circle which describes the line of contact of the metal with the mould wall.

The lower, gas-carrying part of the mould wall, the gas ring 13, may expediently be made of another material, for example sintered metal or graphite material.

Figure 2:
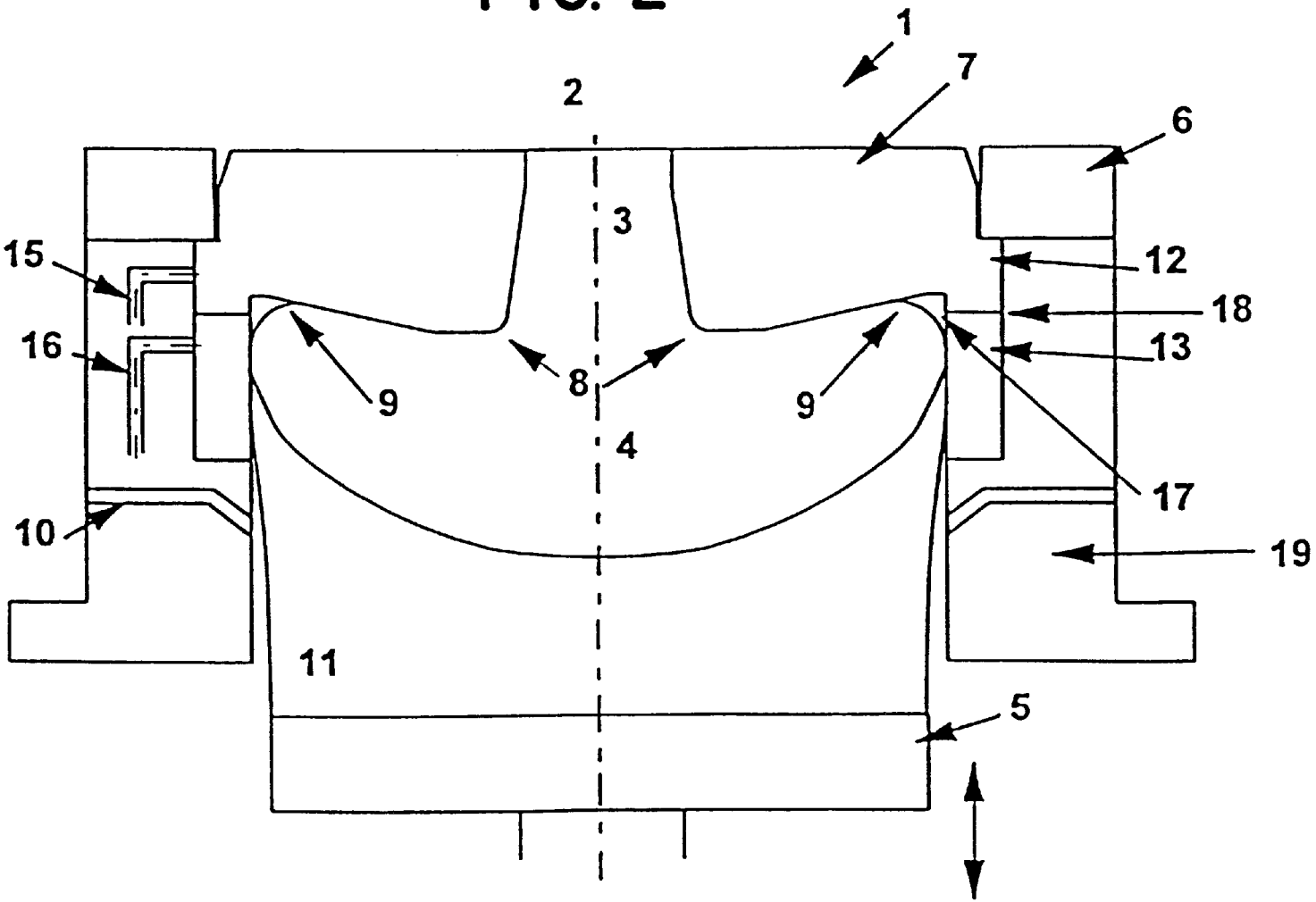
FIG. 2 shows the same casting mould, but with an alternative design for the supply of oil and gas.

FIG. 2 shows an alternative embodiment in which the hot-top 7 with the integrated oil part 12 consists physically. of one single part. I.e. there is no barrier layer. The embodiment chosen depends on the maintenance interval and the alloys to be cast. Alternative 2 will be cheaper to manufacture but may have a shorter practical life.

Figure 3:
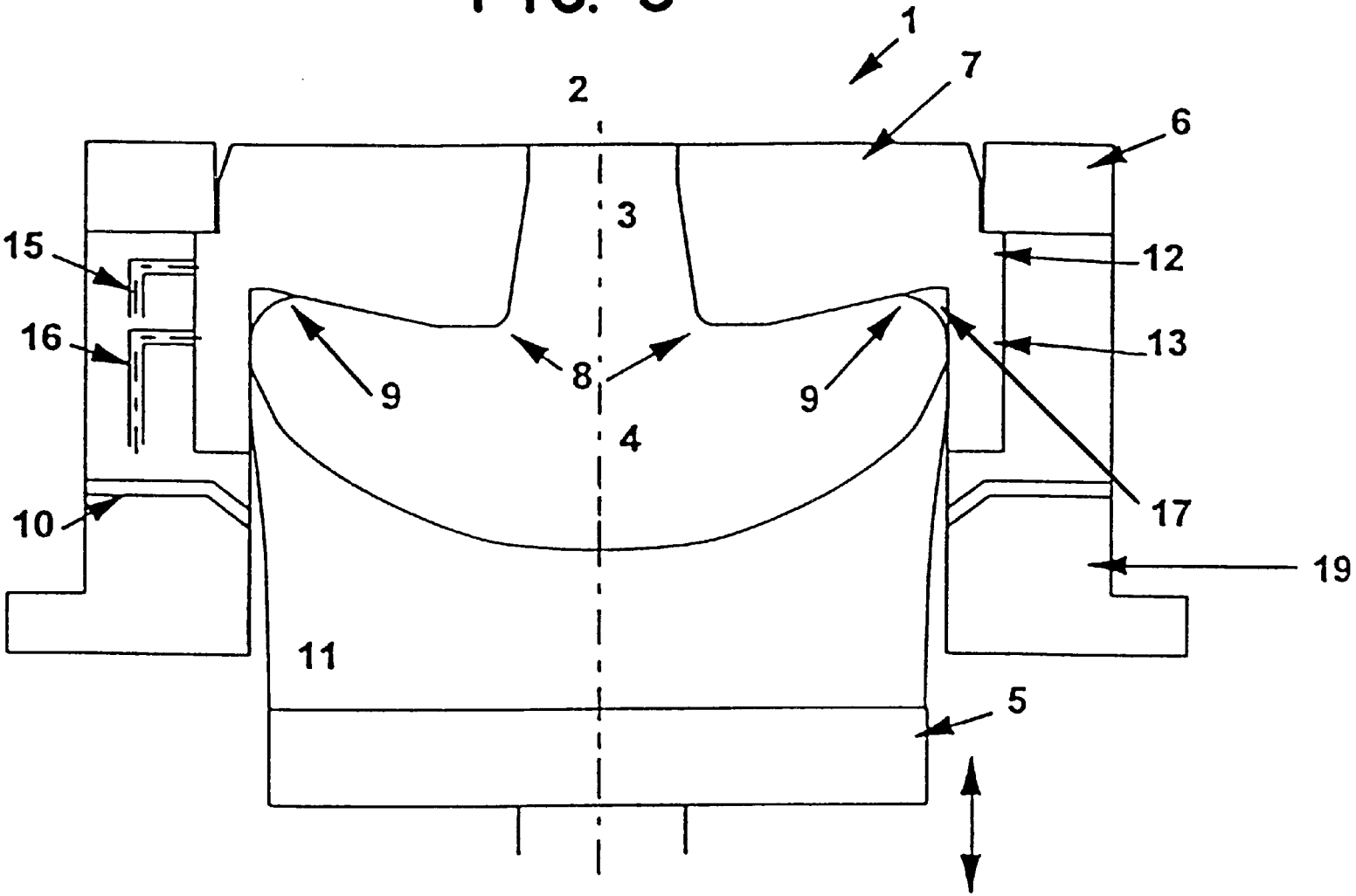
FIG. 3 shows another design for the supply of oil and gas.

FIG. 3 shows a solution in which the hot-top 7, the oil part 12 and the gas part 13 in the cavity of the casting mould constitute an integrated unit, i.e. in the same material and with no barrier layer between the three parts.

This embodiment represents the very simplest and cheapest version to produce. However, the life will be shorter, as, over time, the oil will carbonise in the solidification area of the metal.

Regarding the material of which the hot-top and the oil/gas elements are made, tests have been carried out on standard fireproof material of type Pyrotek-N17, which is based on Ca silicate. However, other fireproof materials can also be used if they have permeable properties which allow the penetration of oil and gas.

I claim:

1. A casting equipment for the continuous or semi-continuous direct chill casting of metal, said equipment comprising:

a mold having therein a cavity having an upwardly open inlet leading into said cavity, an intermediate overhang and a lower outlet leading from said cavity, whereby molten metal supplied through said inlet solidifies in said cavity and discharges through said outlet;

a vertically movable support at said outlet to support the metal;

a water supply for supply of water to chill the metal;

said inlet and said overhang being defined by a hot-top formed in refractory insulating material;

at least a portion of a wall of said mold defining said cavity being permeable for the supply therethrough of oil and gas into said cavity to form an oil and gas layer between the metal and said portion of said wall, thereby preventing the metal from coming into direct contact with said portion of said wall; and at least said portion of said wall employed for the supply therethrough of oil into said cavity being formed of the same said refractory insulating material forming said hot-top and being integral therewith.

2. A casting equipment as claimed in claim 1, wherein said portion of said wall employed for the supply therethrough of oil into said cavity comprises an oil distribution ring formed of said material and glued to said hot-top to define a glued joint therebetween.

3. A casting equipment as claimed in claim 4, wherein a portion of said wall employed for the supply therethrough of gas into said cavity is formed of another material different from said material.

4. A casting equipment as claimed in claim 3, wherein said portion of said wall employed for the supply therethrough of gas into said cavity comprises a gas carrying ring positioned below said oil distribution ring.

5. A casting equipment as claimed in claim 1, wherein a portion of said wall employed for the supply therethrough of gas into said cavity is formed of another material different from said material.

6. A casting equipment as claimed in claim 5, wherein said portion of said wall employed for the supply therethrough of gas into said cavity comprises a gas carrying ring positioned below said portion of said wall employed for the supply therethrough of oil.

7. A casting equipment as claimed in claim 1, wherein said hot-top and said portion of said wall employed for the supply therethrough of oil together comprise a unitary one-piece member formed from said material.

8. A casting equipment as claimed in claim 7, wherein a portion of said wall employed for the supply therethrough of gas into said cavity is formed of another material different from said material.

9. A casting equipment as claimed in claim 8, wherein said portion of said wall employed for the supply therethrough of gas into said cavity comprises a gas carrying ring positioned below said unitary one-piece member.

10. A casting equipment as claimed in claim 1, wherein said hot-top, said portion of said wall employed for the supply therethrough of oil, and a portion of said wall employed for the supply therethrough of gas together comprise a unitary one-piece member formed from said material.

* * * * *